US011305558B2

(12) United States Patent
Washio et al.

(10) Patent No.: US 11,305,558 B2
(45) Date of Patent: Apr. 19, 2022

(54) MEDIUM HEATING DEVICE AND LIQUID EJECTING DEVICE

(71) Applicant: SEIKO EPSON CORPORATION, Tokyo (JP)

(72) Inventors: Yuichi Washio, Shiojiri (JP); Daisuke Fujiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/777,321

(22) Filed: Jan. 30, 2020

(65) Prior Publication Data

US 2020/0247143 A1 Aug. 6, 2020

(30) Foreign Application Priority Data

Jan. 31, 2019 (JP) ..... JP2019-015287

(51) Int. Cl.
*B41J 11/00* (2006.01)
*B41J 11/02* (2006.01)

(52) U.S. Cl.
CPC ..... *B41J 11/002* (2013.01); *B41J 11/0024* (2021.01); *B41J 11/00212* (2021.01); *B41J 11/00216* (2021.01); *B41J 11/02* (2013.01)

(58) Field of Classification Search
CPC ..... B41J 11/002; B41J 11/02
See application file for complete search history.

(56) References Cited

U.S. PATENT DOCUMENTS 9,254,684 B2 2/2016 Kitagishi et al.
2013/0016167 A1* 1/2013 Kitagishi ..... B41J 11/002 347/102
2017/0282612 A1* 10/2017 Takahashi ..... B41J 29/04

FOREIGN PATENT DOCUMENTS

JP 2013-022750 2/2013

* cited by examiner

*Primary Examiner* — Matthew Luu
*Assistant Examiner* — Kendrick X Liu
(74) *Attorney, Agent, or Firm* — Workman Nydegger

(57) ABSTRACT

A medium heating device includes a support portion configured to support a medium being transported, a heating unit configured to heat a medium supported by the support portion, and a detector configured to detect a temperature of the support portion. The support portion includes a metal plate including a first surface as the support face, an end portion of the metal plate is bent toward an opposite side to the first surface, the metal plate is fixed by a fixing portion and a fixing portion next to the fixing portion in a width direction, and a detection position of the detector is set to a position between the mutually adjacent fixing portions in the width direction.

8 Claims, 3 Drawing Sheets

MEDIUM HEATING DEVICE AND LIQUID EJECTING DEVICE

The present application is based on, and claims priority from JP Application Serial Number 2019-015287, filed Jan. 31, 2019, the disclosure of which is hereby incorporated by reference herein in its entirety.

BACKGROUND

The present disclosure relates to a medium heating device and a liquid ejecting device.

JP-A-2013-22750 describes a medium heating device including a support portion that supports, on a support face, a medium to be transported, first heating units arranged in a direction intersecting a transport direction, a second heating unit that is positioned between the adjacent first heating units and that extends in the transport direction, and a detector that detects a temperature of the support portion.

SUMMARY

In such a medium heating device, the drive of the heater is controlled based on the temperature detected by the detector to heat the medium at an appropriate temperature. On the other hand, the support portion that deforms due to thermal expansion forms a gap between a portion of the support face and the medium, and causes variation in a distance between the support face and the medium. As a result, the temperature detected by the detector may include errors, which may lead to the temperature of the medium becoming too high or the temperature of the medium becoming too low.

The present disclosure is directed to the above-described problem. A medium heating device, according to the present disclosure, includes a support portion including a support face and configured to support a medium being transported, a heating unit configured to heat the medium supported by the support portion, a detector configured to detect a temperature of the support portion, and a control unit configured to control an output of the heating unit, based on the temperature detected by the detector. In the medium heating device, the support portion includes a metal plate including a first surface as the support face, an end portion of the metal plate is bent toward an opposite side from the first surface, the metal plate is fixed to a first fixing portion and a second fixing portion next to the first fixing portion in a width direction, and a detection position of the detector is set between the first fixing portion and the second fixing portion in the width direction.

A liquid ejecting device, according to the present disclosure, includes a support portion including a support face and configured to support a medium being transported, a heating unit configured to heat the medium supported by the support portion, a detector configured to detect a temperature of the support portion, and a control unit configured to control an output of the heating unit, based on the temperature detected by the detector. In the liquid ejecting device, the support portion includes a metal plate including a first surface as the support face, an end portion of the metal plate is bent toward an opposite side from the first surface, the metal plate is fixed to a first fixing portion and a second fixing portion that is next to the first fixing portion in a width direction, and a detection position of the detector is set between the first fixing portion and the second fixing portion in the width direction.

DESCRIPTION OF EXEMPLARY EMBODIMENTS

An embodiment of a liquid ejecting device including a medium heating device will be described below with reference to the drawings. The liquid ejecting device is, for example, an ink jet-type printer that records an image such as characters and photographs on a medium such as a sheet by ejecting ink, which is an example of a liquid.

Figure 1:
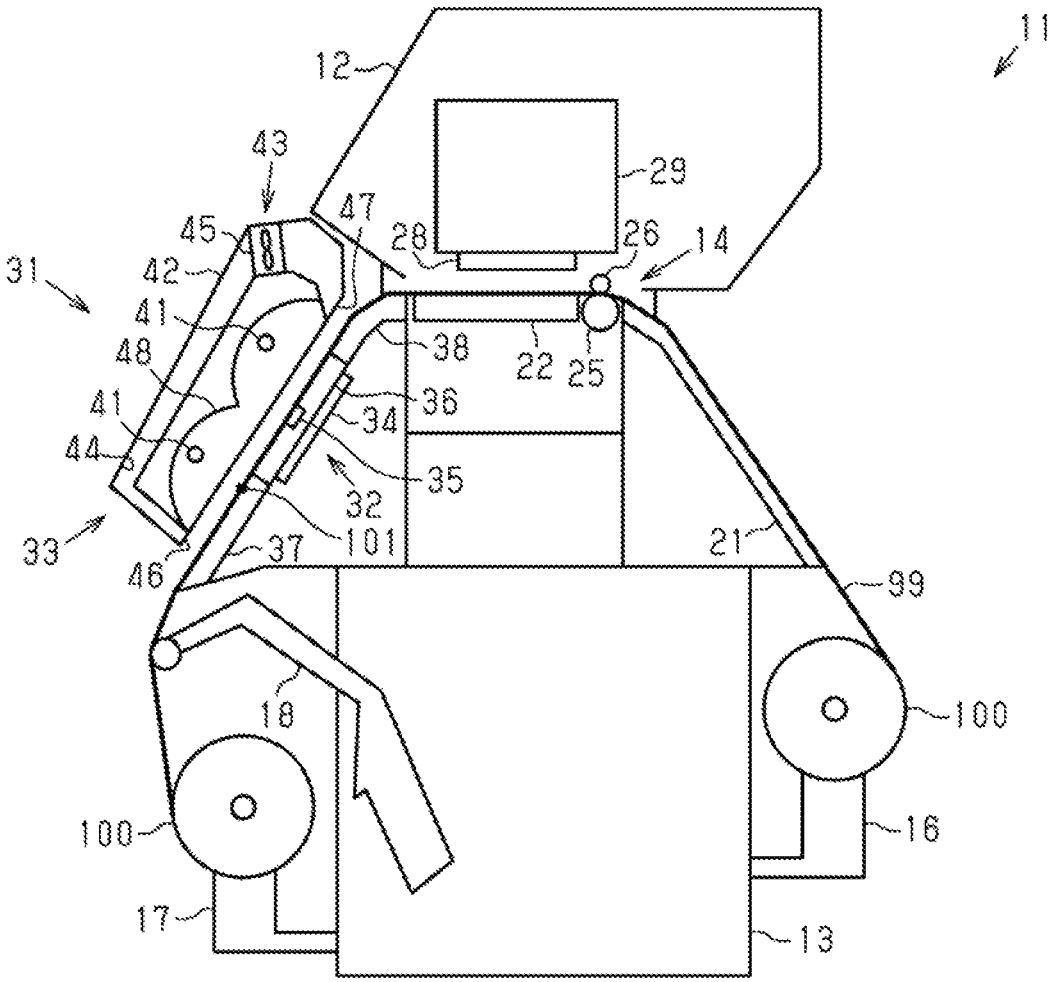
FIG. 1 is a side view schematically illustrating an embodiment of a liquid ejecting device including a medium heating device.

As illustrated in FIG. 1, a liquid ejecting device 11 includes an ejecting unit 28 that ejects liquid onto a medium 99 to be transported. The liquid ejecting device 11 includes a medium heating device 31 that heats the medium 99 to be transported. The medium heating device 31 of the present embodiment dries the medium 99 onto which liquid has been ejected by the ejecting unit 28.

The liquid ejecting device 11 includes a housing 12. The liquid ejecting device 11 includes a base 13 that supports the housing 12. In the present embodiment, the housing 12 is positioned above the base 13.

The liquid ejecting device 11 includes a transport unit 14 that transports a medium 99. The transport unit 14 is provided in the housing 12. The transport unit 14 of the present embodiment transports the medium 99 placed outside the housing 12.

The liquid ejecting device 11 may include a placement unit 16 on which a roll body 100 of the wound medium 99 is placed. The placement unit 16 may be attached to the base 13, for example. The placement unit 16 rotatably supports the roll body 100 of the wound medium 99 before being subjected to the liquid ejection. When the transport unit 14 is driven, the medium 99 is fed from the roll body 100.

It is noted that the medium 99 onto which the liquid ejecting device 11 ejects liquid may be the medium 99 fed from the roll body 100 placed on an installation surface on which the liquid ejecting device 11 is installed. Furthermore, the medium 99 onto which the liquid ejecting device 11 ejects liquid may be the medium 99 fed from the roll body 100 supported by a device other than the liquid ejecting device 11. The medium 99 onto which the liquid ejecting device 11 ejects liquid is not limited to the medium 99 fed from the roll body 100. For example, the liquid ejecting device 11 may eject liquid onto the medium 99 having a long length, such as a fan-hold paper, or may eject liquid onto a single sheet as the medium 99.

The liquid ejecting device 11 may include a winding unit 17 that winds the medium 99. The winding unit 17 may be attached to the base 13, for example. The winding unit 17 winds the medium 99 on which liquid has been ejected as the roll body 100. It is noted that the liquid ejecting device 11 may be configured to transport the medium 99 on which liquid has been ejected to a device other than the liquid ejecting device 11. The liquid ejecting device 11 may be configured to wind the medium 99 on which liquid has been ejected on a device other than the liquid ejecting device 11.

The liquid ejecting device 11 may include a tension bar 18 that provides tension to the medium 99. The length of the medium 99 between the winding unit 17 and the transport unit 14 varies depending on the difference between the feeding amount of the medium 99 in the winding unit 17 and the feeding amount of the medium 99 in the transport unit 14. The tension bar 18 is displaced according to the length of the medium 99 between the winding unit 17 and the transport unit 14. The displacement of the tension bar 18 in contact with the medium 99 allows for application of proper tension to the medium 99. By applying tension to the medium 99 with the tension bar 18, the liquid ejecting device 11 can accurately eject liquid onto the medium 99. The tension bar 18 of the present embodiment contacts a portion of the medium 99 that has passed through the medium heating device 31.

The tension bar 18 may be attached to the base 13, for example. The tension bar 18 attached to the base 13 in a manner allowing for its position to be changed. In this way, by changing the position of the tension bar 18, the amount of the tension applied to the medium 99 can be adjusted.

The liquid ejecting device 11 of the present embodiment includes a first support 21 and a second support 22. The first support 21 and the second support 22 support the medium 99 transported by the transport unit 14. The first support 21 and the second support 22 are located in the order of the first support 21 and the second support 22 in a direction in which the medium 99 is transported. The second support 22 is located in the housing 12.

The ejecting unit 28 is located in the housing 12. The ejecting unit 28 of the present embodiment faces the second support 22. The ejecting unit 28 ejects liquid onto a first surface of the medium 99 that is supported by the second support 22 and that faces the ejecting unit 28.

The liquid ejecting device 11 of the present embodiment includes a carriage 29 on which the ejecting unit 28 is mounted. The carriage 29 scans the transported medium 99. In other words, the liquid ejecting device 11 of the present embodiment is a serial printer in which the ejecting unit 28 scans the medium 99. The liquid ejecting device 11 may be a line printer including the ejecting unit 28 which is long in the width direction of the medium 99.

The transport unit 14 of the present embodiment includes a first roller 25 and a second roller 26. The first roller 25 and the second roller 26 transport the medium 99 by rotating while sandwiching the medium 99. The first roller 25 and the second roller 26 sandwich the medium 99 between the first support 21 and the second support 22.

Next, the medium heating device 31 will be described.

The medium heating device 31 includes a support portion 32 that supports the medium 99, a first heater 33 facing the support portion 32, and a second heater 34 attached to the support portion 32. The first heater 33 and the second heater 34 are examples of heating units. The support portion 32 of the present embodiment supports, on the support face, the medium 99 onto which liquid has been ejected. The support face of the support portion 32 is a surface of the support portion 32 facing the first heater 33. The first heater 33 heats the medium 99 from the first surface of the medium 99 onto which liquid has been ejected.

The support portion 32 includes a first support portion 36 to which the second heater 34 is attached, and a second support portion 37 located downstream from the first support portion 36 along the transport direction of the medium 99 to be transported. In the present embodiment, a portion of the second support portion 37, including an upstream end of the second support portion 37, faces the first heater 33. Note that, in the present embodiment, a direction in which the medium 99 is transported along a transport path is the transport direction.

The support portion 32 of the present embodiment includes a third support portion 38 located upstream from the first support portion 36 along the transport direction. The first support portion 36, the second support portion 37, and the third support portion 38 are arranged in the order of the third support portion 38, the first support portion 36, and the second support portion 37 along the transport direction. In the present embodiment, a portion of the third support portion 38, including a downstream end of the third support portion 38, faces the first heater 33. A portion of the third support portion 38 including an upstream end thereof is located within the housing 12.

In the present embodiment, the first support portion 36, the second support portion 37, and the third support portion 38 include a metal plate including a support face. The metal plate is composed of an aluminum material or SUS material having a thickness of approximately 2 mm, for example. An aluminum material is, for example, a material defined by JIS H 4000. Thus, the uniformity of the temperature on the medium 99 and the efficiency of heating of the medium 99 by the second heater 34 can be enhanced.

The first heater 33 of the present embodiment includes a heater tube 41 that heats the medium 99 supported by the support portion 32, a case 42 that accommodates the heater tube 41, and a circulation unit 43 that circulates gas within the case 42. An opening of the case 42 faces the support face of the support portion 32.

The heater tube 41 faces the support face of the support portion 32, which is a surface that contacts the medium 99. The heater tube 41 is long in a width direction of the medium 99. The heater tube 41 heats the medium 99 supported by the support portion 32. Thus, the medium 99 onto which liquid has been ejected is dried.

The first heater 33 of the present embodiment includes two heater tubes 41. The two heater tubes 41 have a posture in which the extending directions are parallel to each other. The extending direction of the two heater tubes 41 is parallel to the support face of the support portion 32.

The circulation unit 43 includes a circulation path 44 through which gas flows, and a fan 45 located in the circulation path 44. The circulation path 44 is a flow path connecting an intake port 46 through which gas is introduced and a blowing port 47 through which gas is sent out. The circulation path 44 extends around the heater tube 41. The intake port 46 faces the second support portion 37. The blowing port 47 faces the third support portion 38. The circulation unit 43 circulates, within the case 42, gas heated by the first heater 33 and the second heater 34. Thus, drying is promoted at the medium 99 onto which liquid has been ejected.

The medium heating device 31 may include a reflecting plate 48 that reflects heat output by the first heater 33 toward the support portion 32. Thus, the heat output by the first heater 33 can be effectively transferred to the medium 99 onto which liquid has been ejected.

The second heater 34 of the present embodiment is a sheet-shaped heating element. The second heater 34 is attached to a back surface of the first support portion 36. The heat output by the second heater 34 is transferred to the medium 99 through the first support portion 36. Thus, the medium 99 onto which liquid has been ejected is heated from a second surface.

The medium heating device 31 defines a peak position 101 of the first heater 33, on the medium 99 transported on the support face of the support portion 32. The peak position 101 of the first heater 33 is a position where the medium 99 has the highest temperature when the first heater 33 is driven and the second heater 34 is not driven.

The peak position 101 of the first heater 33 faces the first heater 33. The temperature at an object part, which is a portion of the medium 99, increases after the object part is carried onto the support face until the object part is reached to the peak position 101 of the first heater 33, when the first heater 33 is driven and the second heater 34 is not driven.

The peak position 101 of the first heater 33 is determined, for example, by transporting, at a constant velocity, the dried medium 99 provided with a temperature sensor on the surface. In other words, the peak position 101 of the first heater 33 is determined based on a temperature detected by the temperature sensor provided in the medium 99. In the present embodiment, the peak position 101 of the first heater 33 is determined based on a temperature detected by the temperature sensor when the medium 99 is transported at the lowest velocity.

The medium heating device 31 includes a detector 35 that detects a temperature of the first support portion 36. The detector 35 is, for example, a contact type temperature sensor such as a thermistor or a non-contact type temperature sensor such as an infrared temperature sensor. The detector 35 converts the detected temperature of first support portion 36 into an electrical signal. The detector 35 sets, as a detection position, an area where the second heater 34 is not attached in the back surface of the first support portion 36.

Figure 2:
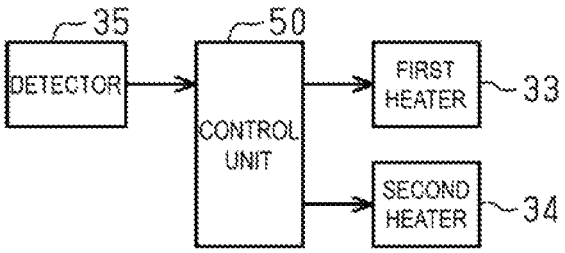
FIG. 2 is a block diagram functionally illustrating a control system for temperature included in the medium heating device.

As illustrated in FIG. 2, the medium heating device 31 includes a control unit 50. The control unit 50 controls outputs of the first heater 33 and the second heater 34 based on the temperature detected by the detector 35. In other words, the control unit 50 stores a set range from the temperature that is equal to or greater than the lowest temperature at which the medium 99 is dried to the temperature that is equal to or less than the temperature at which the medium 99 is not damaged by heat. Then, the control unit 50 controls the outputs of the first heater 33 and the second heater 34 so that the temperature detected by the detector 35 becomes a predetermined value within the set range.

Next, the support portion 32 will be described.

Figure 3:
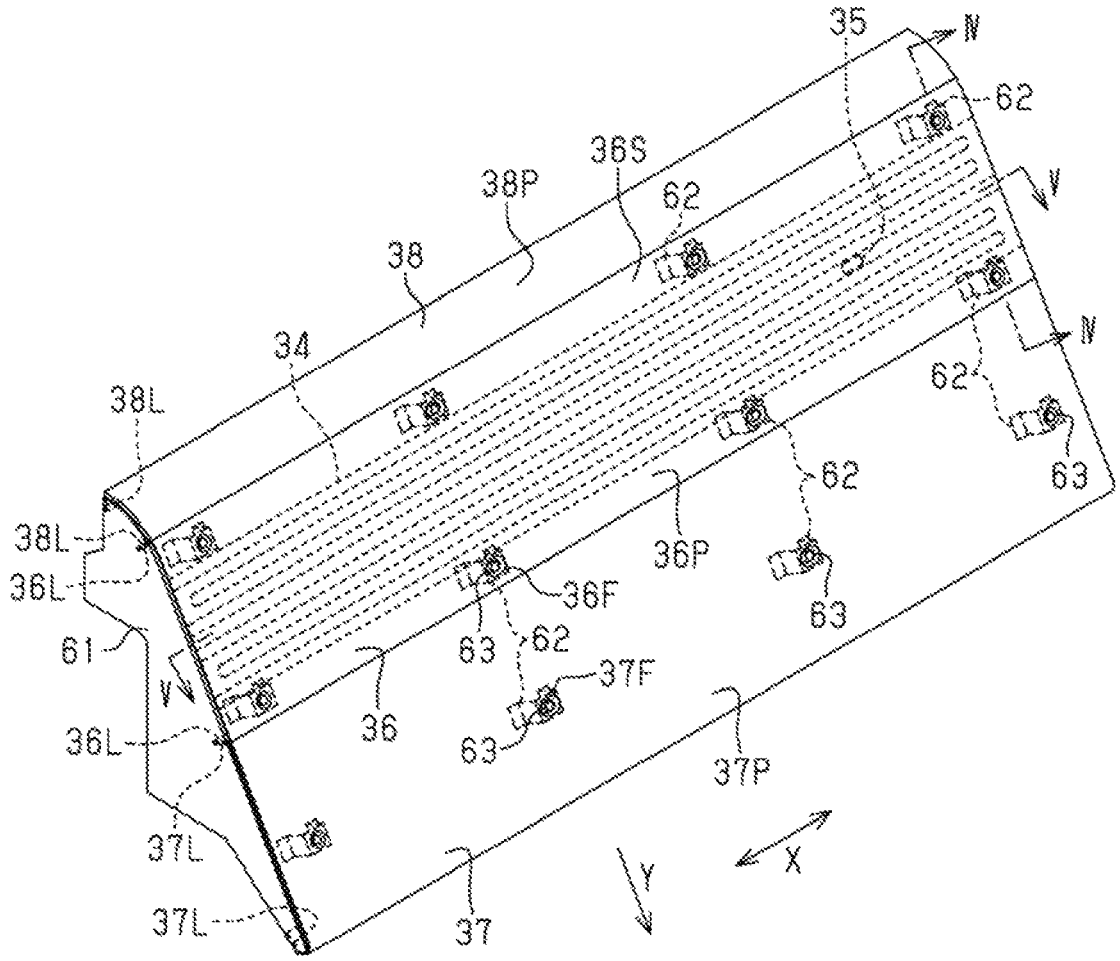
FIG. 3 is a perspective view illustrating a structure of a metal plate included in the medium heating device.

As illustrated in FIG. 3, the first support portion 36 is sandwiched between the second support portion 37 and the third support portion 38 along a transport direction Y of the medium 99. The first support portion 36 includes a first surface 36S as a support face. The first support portion 36 includes a first metal plate 36P including the first surface 36S.

The first metal plate 36P widens along the transport direction Y of the medium 99 and a width direction X orthogonal to the transport direction Y. The first metal plate 36P has a single stripe shape extending in the width direction X. The first metal plate 36P includes an end portion 36L in the transport direction Y that is bent toward the opposite side from the first surface 36S.

The second support portion 37 also includes a second metal plate 37P having a single stripe shape extending in the width direction X. The second metal plate 37P also includes an end portion 37L in the transport direction Y that is bent toward the opposite side from the first surface 36S. The third support portion 38 also includes a third metal plate 38P having a single stripe shape extending in the width direction X. The third metal plate 38P also includes an end portion 38L in the transport direction Y that is bent toward the opposite side from the first surface 36S.

The first metal plate 36P is fixed to a plurality of fixing portions 62 with bolts 63 on the opposite side from the first surface 36S so that the end portion 36L on the downstream side of the first metal plate 36P and the end portion 37L on the upstream side of the second metal plate 37P abut. Further, the first metal plate 36P is fixed to the plurality of fixing portions 62 with the bolts 63 so that the end portion 36L on the upstream side of the first metal plate 36P and the end portion 38L on the downstream side of the third metal plate 38P abut.

The first metal plate 36P includes a first recessed portion 36F through which the bolt 63 is inserted. The first recessed portion 36F includes a through hole through which a shaft portion of the bolt 63 is inserted, and accommodates the head section of the bolt 63. The second metal plate 37P also includes a second recessed portion 37F through which the bolt 63 is inserted. As with the first recessed portion 36F, the second recessed portion 37F includes a through hole through which the shaft portion of the bolt 63 is inserted, and accommodates the head section of the bolt 63.

In the present embodiment, the plurality of fixing portions 62 arranged at intervals in the width direction X constitute a single row of fixing portions 62R. The position in the transport direction Y of each fixing portion 62 of the single row of fixing portions 62R is same as the position in the transport direction Y of other fixing portions 62. In the present embodiment, the single row of fixing portions 62R is constituted by four fixing portions 62. Then, the first metal plate 36P is fixed to two single rows of fixing portions 62R arranged at intervals in the transport direction Y.

In other words, the plurality of fixing portions 62 arranged at intervals in the transport direction Y constitute a single column of fixing portions 62C. The position in the width direction X of each fixing portion 62 of the single column of fixing portions 62C is same as the position in the width direction X of other fixing portions 62. In the present embodiment, the single column of fixing portions 62C is constituted by two fixing portions 62. The first metal plate 36P is fixed to four single columns of fixing portions 62C arranged at equal intervals in the width direction X.

The second heater 34 extends in the width direction X over almost entirely in the width direction X of the first support portion 36. Two second heaters 34 arranged in the transport direction Y are attached to the back surface of the first support portion 36. The two single rows of fixing portions 62R to which the first metal plate 36P is fixed are positioned on the opposite side from the first surface 36S to sandwich the two second heaters 34 in the transport direction Y.

The detection position that is an object position at which the detector 35 detects the temperature is a gap between the two second heaters 34. The detection position of the detector 35 is, in the width direction X, between mutually adjacent fixing portions 62. One of the mutually adjacent fixing portions 62 in the width direction X is an example of a first fixing portion, and the other of the mutually adjacent fixing portions 62 in the width direction X is an example of a second fixing portion positioned next to the first fixing portion. The detection position of the detector 35 is, in the width direction X, set at a position closer to a midpoint between the first fixing portion and the second fixing portion in the width direction X than to either of the first fixing portion and the second fixing portion. Note that, in the present embodiment, a position closer to a midpoint includes the midpoint as well.

The detection position of the detector 35 is, also in the transport direction Y, between the mutually adjacent fixing portions 62. One of the mutually adjacent fixing portions 62 in the transport direction Y is an example of the first fixing portion, and the other of the mutually adjacent fixing portions 62 in the transport direction Y is an example of a third fixing portion positioned next to the first fixing portion. The detection position of the detector 35 is, in the transport direction Y, set at a position closer to a midpoint between the first fixing portion and the third fixing portion in the transport direction Y than to either of the first fixing portion and the third fixing portion.

The second metal plate 37P is fixed to the plurality of fixing portions 62 arranged at equal intervals in the width direction X. In the present embodiment, the metal plate of the second support portion 37 is fixed to the single row of fixing portions 62R.

The support portion 32 includes a pair of side frames 61 in the width direction X. The plurality of fixing portions 62 to which the first metal plate 36P is fixed and the plurality of fixing portions 62 to which the second metal plate 37P is fixed are fixed to a support frame that is laid on the pair of side frames 61.

The medium heating device 31 determines the degree of drying of the medium 99 onto which liquid has been ejected, based on the amount of heat to be input to the medium 99 and the time for heating the medium 99. To quickly dry the medium 99, the medium 99 may be quickly heated to the elevated temperature. To quickly heat the medium 99 to the elevated temperature, the temperature on the support face of the support portion 32 may be increased. However, when the temperature on the support face exceeds the set range and the temperature of the medium 99 becomes too high, the medium 99 may be damaged by heat. In addition, when the temperature on the support face falls below the set range and the temperature of the medium 99 becomes too low, drying of the medium 99 may be insufficient.

In particular, in the first metal plate 36P including the end portion 36L bent toward the opposite side from the first surface 36S, a portion between the first fixing portion and the second fixing portion in the width direction X is likely to protrude toward the medium due to thermal expansion of the first metal plate 36P. Furthermore, a portion between the first fixing portion and the third fixing portion in the transport direction Y is also likely to protrude toward the medium due to thermal expansion of the first metal plate 36P. Then, when deformation due to thermal expansion occurs in the first metal plate 36P, a gap is formed between a portion of the first surface 36S and the medium 99, and variation occurs in the distance between the first surface 36S and the medium 99. The variation in the distance between the first surface 36S and the medium 99 may cause variation in temperature at the first metal plate 36P, and this may result in deviation of amounts of driving of the first heater 33 and the second heater 34 that use the temperature of the first metal plate 36P.

Figure 4:
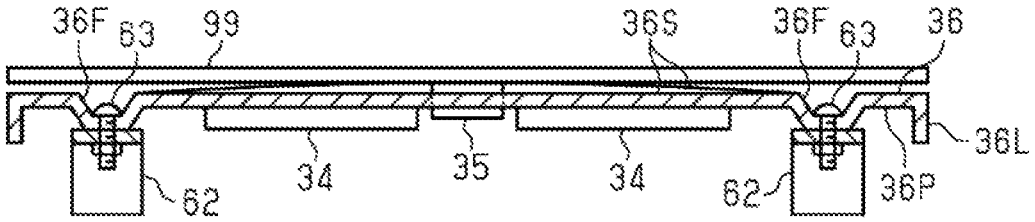
FIG. 4 is a cross-sectional view taken along IV-IV of FIG. 1.

As illustrated in FIG. 4, when deformation due to thermal expansion occurs in the first metal plate 36P, a gap is formed between a portion of the first surface 36S and the medium 99, and variation occurs in the distance between the first surface 36S and the medium 99, in the transport direction Y. When compared a portion of the first metal plate 36P which is closest to the medium 99 and a portion of the first metal plate 36P which is farthest from the medium 99, there is difference in an endothermic amount by the medium 99, so the temperature at the first metal plate 36P also differs.

On the other hand, the detection position of the detector 35 is, in the transport direction Y, between the mutually adjacent fixing portions 62, and is closer to the midpoint between the first fixing portion and the third fixing portion in the transport direction Y than to either of the first fixing portion and the third fixing portion. In other words, the detection position of the detector 35 is, in the transport direction Y, a portion that protrudes toward the medium 99 side and a portion that can be closest to the medium 99 compared to a position fixed to each fixing portion 62.

Figure 5:
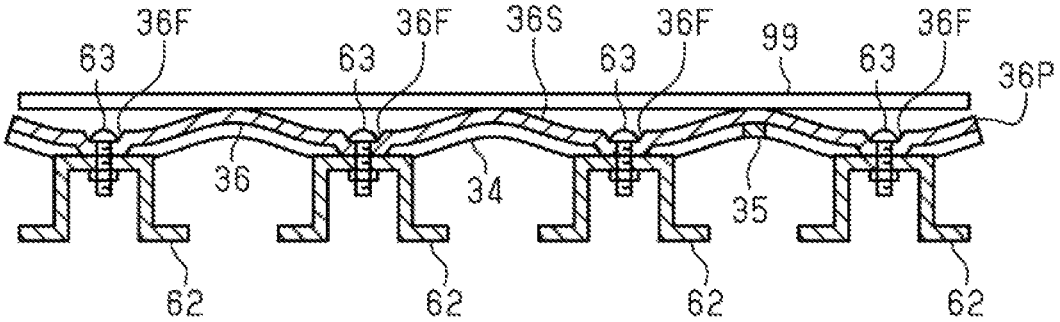
FIG. 5 is a cross-sectional view taken along V-V of FIG. 1.

As illustrated in FIG. 5, the first metal plate 36P that deforms due to thermal expansion forms a gap between a portion of the first surface 36S and the medium 99, and causes variation in the distance between the first surface 36S and the medium 99, in the width direction X. When compared a portion of the first metal plate 36P which is closest to the medium 99 and a portion of the first metal plate 36P which is farthest from the medium 99, there is difference in an endothermic amount by the medium 99, so the temperature at the first metal plate 36P also differs.

Again, the detection position of the detector 35 is, in the width direction X, between the mutually adjacent fixing portions 62, and is closer to the midpoint between the first fixing portion and the second fixing portion in the width direction X than to either of the first fixing portion and the second fixing portion. In other words, the detection position of the detector 35 is, also in the width direction X, a portion that protrudes toward the medium 99 side and a portion that can be closest to the medium 99 compared to a position fixed to each fixing portion 62.

Therefore, the distance between the detection position of the detector 35 and the medium 99 is hardly increased even in the thermally expanded metal plate. As a result, errors caused by the variation in the distance between the detection position of the detector 35 and the medium 99 can be suppressed from being included in the detection result of the detector 35. Thus, damage on the medium 99 due to the temperature of the medium 99 becoming too high can be suppressed. In addition, deterioration in quality of printing due to the temperature of the medium 99 becoming too low can be suppressed.

Next, the functions and effects of the above-described embodiment will be described.

In the first metal plate 36P including the end portion 36L bent toward the opposite side from the first surface 36S, a portion between the mutually adjacent fixing portions 62 in the width direction X is likely to protrude toward the medium 99 due to thermal expansion of the first metal plate 36P.

In this regard, the detection position of the detector 35 is set between the mutually adjacent fixing portions 62 in the width direction X, that is, a part that is likely to protrude toward the medium 99, and thus, the distance between the detection position of the detector 35 and the medium 99 is hardly increased even in the thermally expanded first metal plate 36P. Therefore, errors caused by the variation in the distance between the detection position of the detector 35 and the medium 99 can be suppressed from being included in the detection result of the detector 35. Accordingly, damage on the medium 99 due to the temperature of the medium 99 becoming too high and insufficient heating due to the temperature of the medium 99 becoming too low can be suppressed.

In addition, the temperature of the medium 99 becoming too high or the temperature of the medium 99 becoming too low is suppressed, and thus, the degree of drying of the medium 99 onto which liquid has been ejected can be stabilized.

In particular, the temperature of the medium 99 onto which liquid has been ejected tends to be lower compared to the temperature of the medium 99 onto which liquid has not been ejected, and thus, the temperature of the first support portion 36 detected by the detector 35 is prone to be greatly affected by the distance between the detection position of the detector 35 and the medium 99. Therefore, the effects according to (1) described above becomes more evident.

In the first metal plate 36P that deforms due to thermal expansion, the midpoint between the mutually adjacent fixing portions 62 is most likely to protrude toward the medium 99 in the width direction X. In this regard, the detection position of the detector 35 is closer to the midpoint between the mutually adjacent fixing portions 62 compared to the mutually adjacent fixing portions 62 in the width direction X. Therefore, the distance between the detection position of the detector 35 and the medium 99 is further hardly increased. As a result, damage on the medium 99 and insufficient heating can be further suppressed.

In the first metal plate 36P including the end portion 36L bent toward the opposite side from the first surface 36S, a portion between the mutually adjacent fixing portions 62 in the transport direction Y is also likely to protrude toward the medium 99 due to thermal expansion of the first metal plate 36P. In this regard, the detection position of the detector 35 is set between the mutually adjacent fixing portions 62 in the transport direction Y, that is, a part that is likely to protrude toward the medium 99. Therefore, in conjunction with the effects described in (1) described above, the distance between the detection position of the detector 35 and the medium 99 is further hardly increased even in the thermally expanded first metal plate 36P. Accordingly, damage on the medium 99 due to the temperature of the medium 99 becoming too high and insufficient heating due to the temperature of the medium 99 becoming too low can be further suppressed.

In the first metal plate 36P that deforms due to thermal expansion, the midpoint between the mutually adjacent fixing portions 62 is most likely to protrude toward the medium 99 in the transport direction Y. In this regard, the detection position of the detector 35 is closer to the midpoint between the mutually adjacent fixing portions 62 compared to the mutually adjacent fixing portions 62 in the transport direction Y. Therefore, the distance between the detection position of the detector 35 and the medium 99 is further hardly increased. As a result, damage on the medium 99 and insufficient heating can be further suppressed.

The present embodiment may be modified as follows. The present embodiment and modified examples described below may be implemented in combination as long as a technical contradiction does not arise.

As with the second metal plate 37P, the first metal plate 36P may be fixed to the single row of fixing portions 62R or may be fixed to three or more single rows of fixing portions 62R. Furthermore, the first metal plate 36P may be fixed to two or three single columns of fixing portions 62C or to five or more single columns of fixing portions 62C.

In any of the modifications, with a configuration in which the detection position of the detector 35 is set between the mutually adjacent fixing portions 62 in the width direction X, the effects according to (1) and (2) described above are obtained. In addition, with a configuration in which the detection position of the detector 35 is set between the mutually adjacent fixing portions 62 in the transport direction Y, the effects according to (4) described above are obtained.

The detection position of the detector 35 can be changed to a position that is between the mutually adjacent fixing portions 62 in the width direction X and that is, in the transport direction Y, closer to the fixing portions 62 compared to the midpoint between the mutually adjacent fixing portions 62 in the transport direction Y. Even in this modification, the detection position of the detector 35 is set between the mutually adjacent fixing portions 62 in the width direction X, so the effects according to (1) and (2) described above are obtained.

The medium 99 is not limited to being a long paper fed from the roll body 100, and may be a single sheet. The medium 99 is not limited to paper, and may be fiber.

The liquid ejected by the ejecting unit 28 is not limited to ink, and may be, for example, a liquid material including particles of a functional material dispersed or mixed in liquid. For example, the ejecting unit 28 may eject a liquid material including a material such as an electrode material pixel material used in manufacture of liquid crystal display, an electroluminescent (EL) display, and a surface emitting display in a dispersed or dissolved form.

Hereinafter, technical concepts and effects thereof that are understood from the above-described embodiments and modified examples will be described.

A medium heating device includes a support portion including a support face and configured to support a medium being transported, a heating unit configured to heat the medium supported by the support portion, a detector configured to detect a temperature of the support portion, and a control unit configured to control an output of the heating unit, based on the temperature detected by the detector. In the medium heating device, the support portion includes a metal plate including a first surface as the support face, an end portion of the metal plate is bent toward an opposite side from the first surface, the metal plate is fixed to a first fixing portion and a second fixing portion that is next to the first fixing portion in a width direction, and a detection position of the detector is set to a position between the first fixing portion and the second fixing portion in the width direction.

A liquid ejecting device includes a support portion including a support face and configured to support a medium being transported, a heating unit configured to heat the medium supported by the support portion, a detector configured to detect a temperature of the support portion, and a control unit configured to control an output of the heating unit, based on the temperature detected by the detector. In the liquid ejecting device, the support portion includes a metal plate including a first surface as the support face, an end portion of the metal plate is bent toward an opposite side from the first surface, the metal plate is fixed, in a width direction, by a first fixing portion and a second fixing portion that is next to the first fixing portion, and a detection position of the detector is set to a position between the first fixing portion and the second fixing portion in the width direction.

In the metal plate including the end portion bent toward the opposite side from the first surface, a portion between the first fixing portion and the second fixing portion in the width direction is likely to protrude toward the medium due to thermal expansion of the metal plate. According to the above-described configuration, the detection position of the detector is set to between the first fixing portion and the second fixing portion, that is, a part that is likely to protrude toward the medium, and thus, the distance between the detection position of the detector and the medium is hardly increased even in the thermally expanded metal plate. Therefore, errors caused by variation in the distance between the detection position of the detector and the medium can be suppressed from being included in the detection result of the detector. Accordingly, damage on the medium due to the temperature of the medium becoming too high and insufficient heating due to the temperature of the medium becoming too low can be suppressed.

In the above-described medium heating device, the medium may be a medium onto which liquid was ejected.

According to this configuration, the temperature of the medium becoming too high or the temperature of the medium becoming too low is suppressed, and thus, the degree of drying of the medium onto which liquid has been ejected can be stabilized.

In particular, the temperature of the medium onto which liquid has been ejected tends to be lower compared to the temperature of the medium onto which liquid has not been ejected, and thus, the temperature of the support portion detected by the detector is prone to be greatly affected by the distance between the detection position of the detector and the medium. Therefore, the effect of suppressing damage on the medium and the effect of suppressing deterioration in quality of printing become more evident.

In the above-described medium heating device, in the width direction, the detection position of the detector may be set to a position closer to a midpoint between the first fixing portion and the second fixing portion in the width direction than to either of the first fixing portion and the second fixing portion.

In the metal plate that deforms due to thermal expansion, the midpoint between the first fixing portion and the second fixing portion in the width direction is most likely to protrude toward the medium. In this regard, according to the above-described configuration, the detection position of the detector is, in the width direction, closer to the midpoint between the first fixing portion and the second fixing portion than to the first fixing portion and the second fixing portion. Therefore, the distance between the detection position of the detector and the medium is further hardly increased. As a result, damage on the medium and insufficient heating can be further suppressed.

In the above-described medium heating device, the first fixing portion and the second fixing portion may be in the same position in a transport direction of the medium, the metal plate may be fixed to a third fixing portion that is next to the first fixing portion in the transport direction, and in the transport direction, a detection position of the detector may be set to a position between the first fixing portion and the third fixing portion.

In the metal plate including the end portion bent toward the opposite side from the first surface, a portion between the first fixing portion and the third fixing portion in the transport direction is likely to protrude toward the medium due to thermal expansion of the metal plate. In this regard, according to the above-described configuration, the detection position of the detector is set to between the first fixing portion and the third fixing portion, and thus, the distance between the medium supported on the first surface and the first surface is further stabilized at the detection position. As a result, damage on the medium and insufficient heating can be further suppressed.

In the above-described medium heating device, in the transport direction, the detection position of the detector may be set to a position closer to a midpoint between the first fixing portion and the third fixing portion in the transport direction than to either of the first fixing portion and the third fixing portion.

In the metal plate that deforms due to thermal expansion, the midpoint between the first fixing portion and the third fixing portion in the transport direction is most likely to protrude toward the medium. In this regard, according to the above-described configuration, the detection position of the detector is, in the transport direction, closer to the midpoint between the first fixing portion and the third fixing portion than to the first fixing portion and the third fixing portion. Therefore, the distance between the detection position of the detector and the medium is further hardly increased. As a result, damage on the medium can be further suppressed.

The above-described medium heating device includes a support portion including a support face and configured to support a medium, a heating unit configured to heat the medium supported by the support portion, a detector configured to detect a temperature of the support portion, and a control unit configured to control an output of the heating unit, based on the temperature detected by the detector, and the support portion includes a metal plate including a first surface as the support face, the metal plate is fixed to a first fixing portion, and the detector detects a temperature of a portion of the metal plate protruding further toward a side of the medium supported by the supporting portion than a portion of the metal plate fixed to the first fixing portion.

The metal plate that receives the heat output by the heating unit deforms due to thermal expansion of the metal plate, and a portion of the first surface protrudes toward the medium compared to the first fixing portion. In this regard, according to the above-described configuration, the detector detects a temperature of a portion protruding toward a side of the medium compared to the first fixing portion, and thus, the distance between the detection position of the detector and the medium becomes shorter than the distance between the first fixing portion and the medium. Therefore, errors caused by the increase in the distance between the detection position of the detector and the medium can be suppressed from being included in the detection result of the detector. Thus, damage on the medium due to the temperature of the medium becoming too high can be suppressed.

What is claimed is:

1. A medium heating device comprising:

a support portion including a support face and configured to support a medium being transported;

a heating unit configured to heat the medium supported by the support portion;

a detector configured to detect a temperature of the support portion; and a control unit configured to control an output of the heating unit, based on the temperature detected by the detector, wherein the support portion includes a metal plate including a first surface as the support face, an end portion of the metal plate is bent toward an opposite side from the first surface, the metal plate is fixed to a first fixing portion and a second fixing portion that is next to the first fixing portion in a width direction, a detection position of the detector is set between the first fixing portion and the second fixing portion in the width direction, in the width direction, the detection position of the detector is set at a position closer to a midpoint between the first fixing portion and the second fixing portion in the width direction than to either of the first fixing portion and the second fixing portion.

2. The medium heating device according to claim 1, wherein the medium is a medium onto which liquid has been ejected.

3. The medium heating device according to claim 1, wherein the first fixing portion and the second fixing portion are in a same position in a transport direction of the medium, the metal plate is fixed by a third fixing portion that is next to the first fixing portion in the transport direction, and the detection position of the detector is set between the first fixing portion and the third fixing portion in the transport direction.

4. The medium heating device according to claim 1, wherein the detector detects a temperature of a portion of the metal plate protruding farther toward a side of the medium supported by the support portion than a portion of the metal plate fixed to the first fixing portion and the second fixing portion.

5. A medium heating device comprising:

a support portion including a support face and configured to support a medium being transported;

a heating unit configured to heat the medium supported by the support portion;

a detector configured to detect a temperature of the support portion; and a control unit configured to control an output of the heating unit, based on the temperature detected by the detector, wherein the support portion includes a metal plate including a first surface as the support face, an end portion of the metal plate is bent toward an opposite side from the first surface, the metal plate is fixed to a first fixing portion and a second fixing portion that is next to the first fixing portion in a width direction, a detection position of the detector is set between the first fixing portion and the second fixing portion in the width direction, the first fixing portion and the second fixing portion are in a same position in a transport direction of the medium, the metal plate is fixed by a third fixing portion that is next to the first fixing portion in the transport direction, and the detection position of the detector is set between the first fixing portion and the third fixing portion in the transport direction.

6. The medium heating device according to claim 5, wherein in the transport direction, the detection position of the detector is set at a position closer to a midpoint between the first fixing portion and the third fixing portion in the transport direction than to either of the first fixing portion and the third fixing portion.

7. The medium heating device according to claim 5, wherein the detector detects a temperature of a portion of the metal plate protruding further toward a side of the medium supported by the support portion than a portion of the metal plate fixed to the first fixing portion and the third fixing portion.

8. A liquid ejecting device comprising:

a support portion including a support face and configured to support a medium being transported;

a heating unit configured to heat the medium supported by the support portion;

a detector configured to detect a temperature of the support portion; and a control unit configured to control an output of the heating unit, based on the temperature detected by the detector, wherein the support portion includes a metal plate including a first surface as the support face, an end portion of the metal plate is bent toward an opposite side from the first surface, the metal plate is fixed by a first fixing portion and a second fixing portion that is next to the first fixing portion in a width direction, and a detection position of the detector is set between the first fixing portion and the second fixing portion in the width direction, in the width direction, the detection position of the detector is set at a position closer to a midpoint between the first fixing portion and the second fixing portion in the width direction than to either of the first fixing portion and the second fixing portion.

* * * * *